US005376788A

United States Patent [19]

Standing et al.

[11] Patent Number: 5,376,788

[45] Date of Patent: Dec. 27, 1994

[54] APPARATUS AND METHOD FOR MATRIX-ASSISTED LASER DESORPTION MASS SPECTROMETRY

[75] Inventors: Kenneth G. Standing; Werner Ens, both of Winnipeg, Canada

[73] Assignee: University of Manitoba, Winnipeg, Canada

[21] Appl. No.: 67,758

[22] Filed: May 26, 1993

[51] Int. Cl.[5] ..... H01J 49/40

[52] U.S. Cl. ..... 250/287; 250/282; 250/288

[58] Field of Search ..... 250/281, 282, 287, 288 R, 250/423 P

[56] References Cited

U.S. PATENT DOCUMENTS

| | | | |
|---|---|---|---|
| 4,472,631 | 9/1984 | Enke et al. | 250/281 |
| 4,694,168 | 9/1987 | Le Beyer et al. | 250/287 |
| 5,045,694 | 9/1991 | Beavu et al. | 250/287 |
| 5,144,127 | 9/1992 | Williams et al. | 250/287 |
| 5,160,840 | 11/1992 | Vestal | 250/287 |
| 5,202,563 | 4/1993 | Cotter et al. | 250/287 |

*Primary Examiner*—Constantine Hannaher
*Assistant Examiner*—James Beyer
*Attorney, Agent, or Firm*—Andrew T. Karnakis; Paul J. Cook; Huw R. Jones

[57] ABSTRACT

An improved apparatus and method for the analysis of ions generated by matrix-assisted laser desorption is disclosed. This apparatus and method enhances the mass spectral resolution compared to previous devices and methods by producing electrical modulation of the kinetic energy imparted to the generated ions in a matrix-assisted laser desorption mass spectrometer. This modulation causes parent ions of interest to be substantially reflected (and detected) or substantially not reflected (and not detected) within the spectrometer, while fragment ions produced from the parent ion of interest are substantially reflected (and detected) independent of said modulation. A difference signal is generated between electrical signals sensed when the parent ions are reflected and electrical signals sensed when the parent ions are not reflected thereby mitigating the effects on the mass spectrum of the undesired fragment ions.

11 Claims, 4 Drawing Sheets

APPARATUS AND METHOD FOR MATRIX-ASSISTED LASER DESORPTION MASS SPECTROMETRY

BACKGROUND OF THE INVENTION

This invention relates generally to mass spectrometry, and in particular to laser desorption time-of-flight mass spectrometers.

Matrix-assisted laser desorption time-of-flight mass spectrometry is a recently developed technique which is particularly useful for the sensitive analysis of large biomolecules. Typically, a few microliters of solution containing sample molecules at concentrations of about 1 82 g/μL are mixed with 10–20 μL of a solution containing matrix molecules at concentrations of about 10 μg/μL. A few microliters of this mixture are then deposited on a suitable substrate and dried in air.

Once the sample has been introduced into the mass spectrometer, a pulsed laser is used to irradiate the sample on the substrate. The interaction of the laser radiation with the matrix molecules leads, by a process that is only partly understood today, to the formation and desorption of largely intact, ionized sample molecules. Predominantly these ions are of a type known as $(M+H)^+$ ions, that is, the neutral sample molecule (M) is ionized by the attachment of a proton. Negatively charged ions may also be formed.

Most frequently these ions are analyzed in so-called linear time-of-flight (TOF) mass spectrometers, that is the ions, once formed, are accelerated by an electric field and then allowed to travel in straight lines until they are detected. The transit time between ion formation and detection can be used to determine the mass of the species from which the ions are generated. A typical linear TOF system is described in U.S. Pat. No. 5,045,694 by Beavis and Chait.

Such linear devices provide only modest mass resolving power, e.g. 50–800, because they are unable to compensate for various known aberrations. A dominant aberration in such linear systems stems from the fact that the ions are formed with a wide distribution of initial velocities. This means that for an ion of a given mass there will be a distribution of arrival times at the detector that will limit the mass resolving power of such a device, since ions with more initial velocity in the forward direction will arrive sooner than ions with less initial velocity in the forward direction.

Techniques for compensating for such aberrations resulting from the initial velocity distribution in TOF mass spectrometers are well-known. The primary technique is to provide an electrostatic mirror, called a Reflectron, which reverses the direction of travel of the ions in such a way that the effects of these initial velocity distributions on ion transit times are eliminated. A recent review article describing such devices is "Time-of-flight Mass Spectrometry: An increasing Role in the Life Sciences", R. J. Cotter, Biomed. Env. Mass Spectrom., vol. 18,513–532 (1989).

Although the use of electrostatic mirrors for the analysis of ions formed by matrix-assisted laser desorption is well-known, the performance of such devices is less than optimal. This is primarily due to the fact that ions thus generated undergo significant rates of metastable decay thereby generating fragment ions during their passage through the mass spectrometer. These fragment ions are a source of error because they cannot easily be distinguished from parent ion peaks, or alternatively they can result in asymmetric peak broadening.

Thus the need exists for a laser desorption TOF mass spectrometer that can differentiate, and hence eliminate, the interference of fragment ions with parent ions of interest.

SUMMARY OF THE INVENTION

The present invention overcomes the disadvantages and limitations of the prior art by providing an enhanced resolution, matrix-assisted laser desorption mass spectrometer wherein the interference of fragment ions on the analysis of parent ions of interest is mitigated. In accordance with a preferred embodiment, the kinetic energy imparted to the parent ions is modulated on successive laser pulses such that these parent ions are alternately detected and not detected by the mass spectrometer. The spectra recorded under these two alternative conditions are recorded and stored in a computer. Difference spectra are generated by subtracting the spectra obtained when parent ions are not detected from the spectra obtained when parent ions are detected.

Further enhancements in spectra quality are obtained by selecting only those signals for analysis which satisfy certain amplitude criteria and normalizing the spectra used to generate the difference spectra.

DESCRIPTION OF PREFERRED EMBODIMENTS

Figure 1:
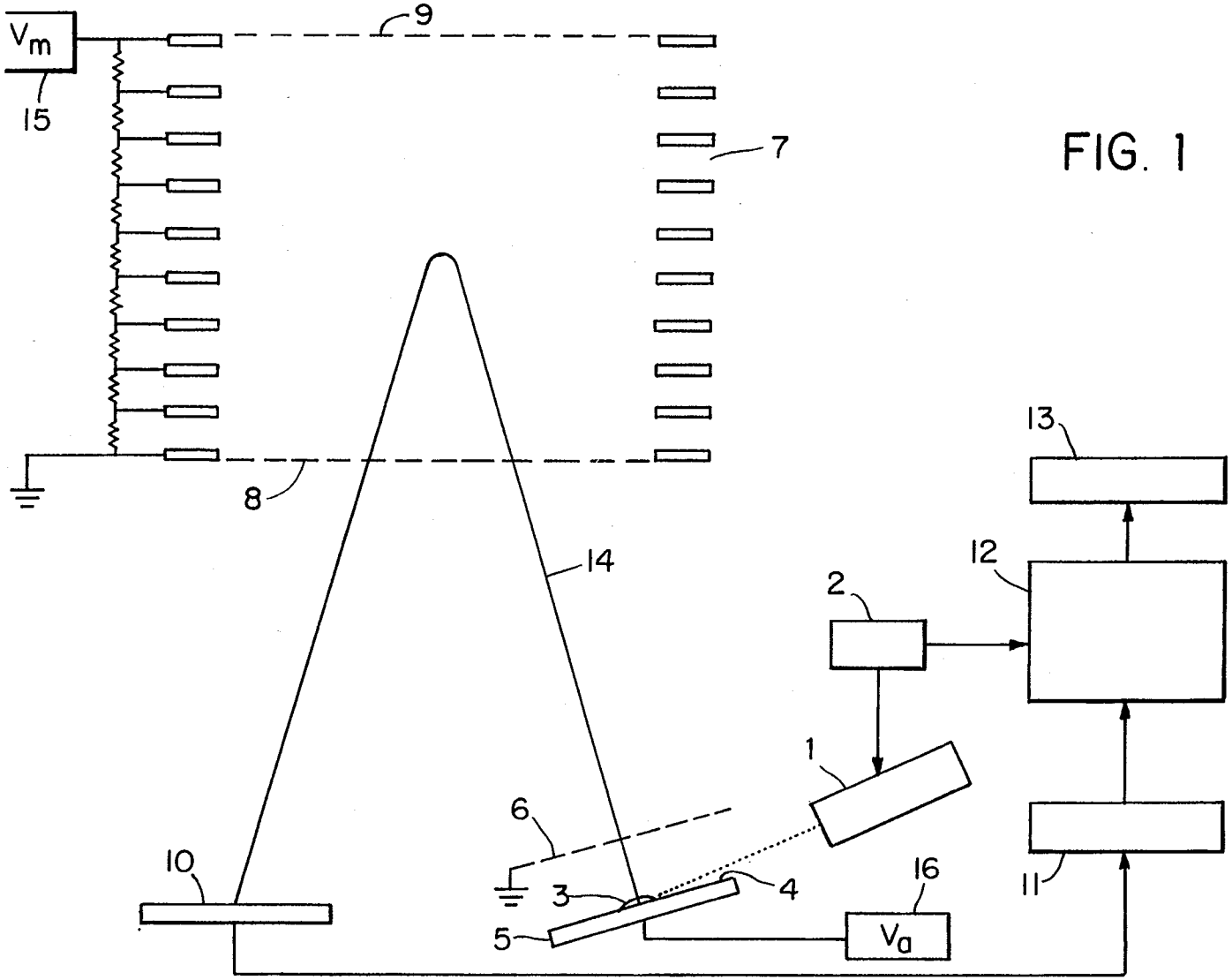
FIG. 1 is a schematic view of a preferred apparatus of this invention.

The invention may be understood by referring to FIG. 1 which depicts schematically a reflecting time-of-flight (TOF) mass spectrometer. A pulsed laser 1 is triggered by a clock 2 and irradiates a sample 3 deposited on the surface 4 of a target substrate 5. This substrate can be placed at an electrical potential $V_a$ with respect to ground by means of a power supply 16. In this embodiment all electrical potentials are assumed to be defined with respect to ground unless otherwise specified. It will be evident to those skilled in the art that in general it will be possible to achieve equivalent results by using other arbitrary reference potentials and such variations are all encompassed within the scope of this invention.

A grid 6 which can take the form of a partially transparent electrode is positioned to face the surface 4 of the substrate 5. This grid is typically, but not necessarily, placed at an electrical potential of ground. Ions formed by the pulse of radiation from laser 1 are accelerated by the electric field existing as a result of the electrical potential difference between the target substrate 5 and the grid 6 and travel along a straight path until they enter an electrostatic mirror 7. A presently preferred form of such a mirror is a single stage mirror, which is depicted in FIG. 1. This mirror generates a constant reflecting field, but other forms (e.g. two-stage mirrors)

are known and are also encompassed by this invention. The mirror includes an entrance end 8 which is placed typically at an electrical potential of ground and an opposite end 9 which is placed at an electrical potential $V_m$ by a power supply source 15.

In conventional operation, Vm >Va such that ions entering the mirror 7 are reflected, exit the mirror at the end 8 and are detected by an ion detector 10. The signal from the ion detector is suitably amplified by preamplifier 11 and recorded by a transient recorder 12 which includes analog-to-digital converters, memory storage and control electronics. An example of such a device is sold by LeCroy Corporation under Model Nos. TR8828D, MM8106 and 6010. The recorded signal is then transferred and stored in a computer 13 before the next laser pulse. In the operation of the present apparatus, signals resulting from ions formed by several successive laser pulses are acquired and may be averaged to increase signal to noise.

In a typical TOF mass spectrometer, elements corresponding to reference numerals 3, 4, 5, 6, 7, 8, 9, 10 and 14 are contained within a vacuum chamber operating at a pressure of $10^{-4}$ Torr or less. Electrical feedthroughs for transmitting the appropriate electrical potentials and signals through the walls of the vacuum chamber, optical paths for the laser beam to enter into the vacuum chamber, and sample transport hardware for introducing samples into the vacuum chamber are included in such a spectrometer in known fashion but are not shown in FIG. 1 for sake of clarity.

Figure 2:
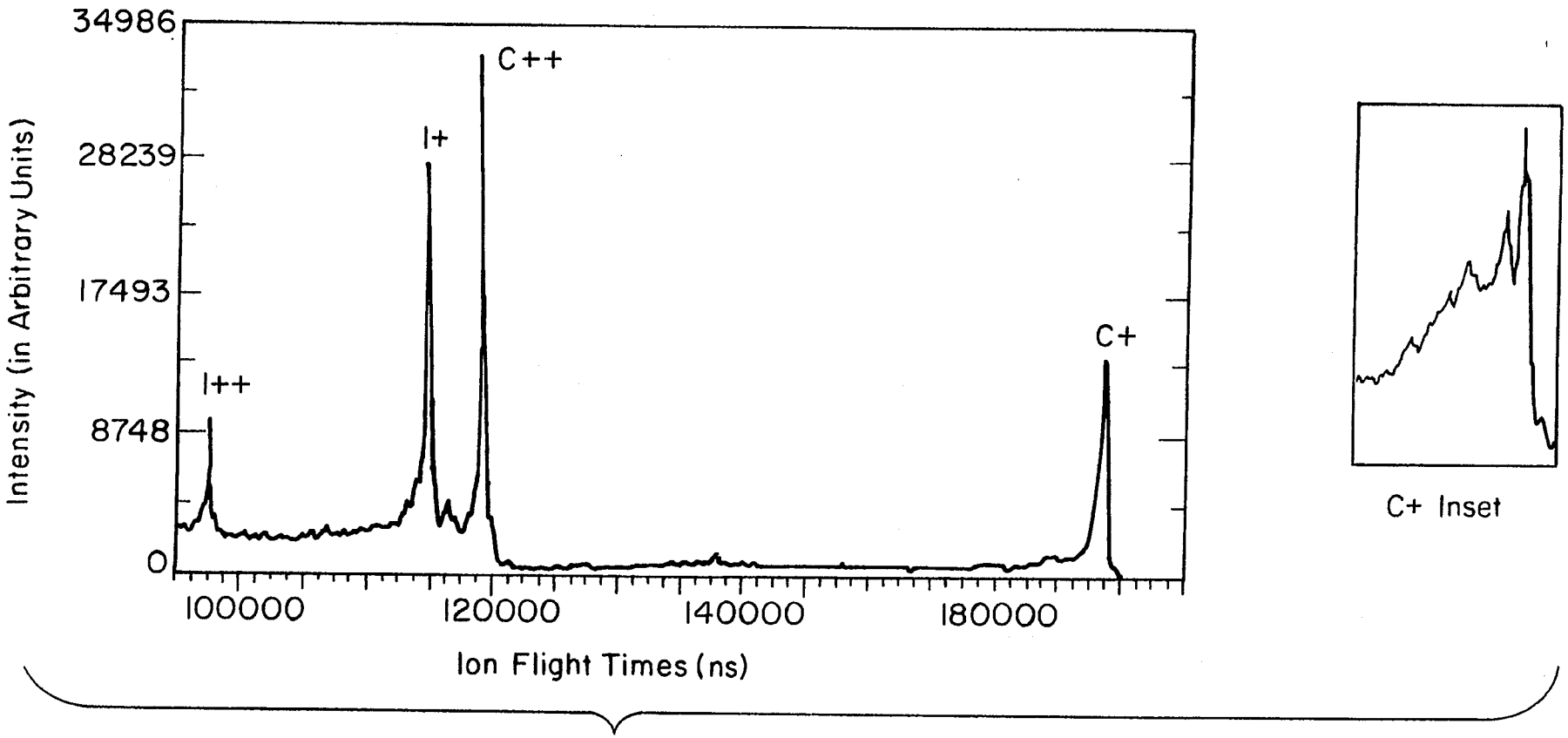
FIG. 2 PRIOR ART
FIG. 2 is a spectrum of a sample mixture of insulin and Cytochrome C which illustrates the performance of the prior art.

A rough representation of a typical ion trajectory 14 is shown in FIG. 1. Under typical operating conditions, fragment ions formed by metastable decay of parent ions traveling in the field-free region between the grid 6 and the mirror entrance end 8 will manifest themselves as false peaks or peak broadening which appear as tails on the low mass side of the parent ion peak. A typical spectrum resulting under these conditions is shown in FIG. 2. This is a spectrum obtained on a sample which is a mixture of insulin (mass peaks labeled as I+and I++) and Cytochrome C (mass peaks labeled as C+ and C++). Both singly and doubly charged species are present.

Fragment ions formed by metastable decay of parent ions have slightly less kinetic energy than their parents by an amount, $E_d$, which can be calculated from established laws of physics. In considering the example in which the fragment ion has the same charge as the parent ion, which is generally the case, it is convenient to represent this energy deficit $E_d$ by the term qVd where q is the electric charge on both the parent and fragment ion and Vd is a voltage difference defined such that $qVd = E_d$. Typically for a molecule of mass 5000 in a TOF mass spectrometer such as depicted in FIG. 1 where $V_a$ is 15 KV, this difference in energy ($E_d$) amounts to about 50 eV.

In accordance with the present invention, the voltage $V_a$ applied to substrate 5 by power supply 16 is set alternately at values of $V_m+\epsilon V_d$ and $V_m-\epsilon V_d$ on successive laser pulses. The term $\epsilon$ is a dimensionless constant whose value is typically 0.3 but the value of $\epsilon$ may range from 0.1 to 0.9. When $V_a=V_m-\epsilon V_d$, all ions (parent and fragment ions) entering the mirror 7 are reflected and then detected by the ion detector 10. When $V_a=V_m+\epsilon V_d$, however, only the fragment ions are reflected as the parent ions have too much energy to be "turned round" by the mirror. For each laser pulse, the signals detected by the detector are recorded and transferred to the computer 13. The computer then is used to generate difference spectra by subtracting the spectra obtained when parent ions are not detected, from the spectra obtained when parent ions are detected. If desired, the signals may be accumulated and averaged prior to carrying out the subtraction.

In matrix-assisted laser desorption ion analysis, there can be significant variations in the ion signal amplitude recorded from different laser pulses even when the laser irradiance is constant. The exact reasons for this are not currently known, but it can be demonstrated that the energy distributions of the ions formed are a function of the signal amplitude. This change in energy distribution can adversely impact the quality of the difference spectra described above. It is therefore preferred, although not essential, to alternate the substrate voltage on alternate laser shots since consecutive shots are less likely to be substantially different.

This scheme of increasing the mass resolution by subtracting the contribution of fragment peaks can be further enhanced by rejecting signals whose amplitude are greater or less than certain threshold values, to obtain greater uniformity in the energy distributions.

Figure 3:
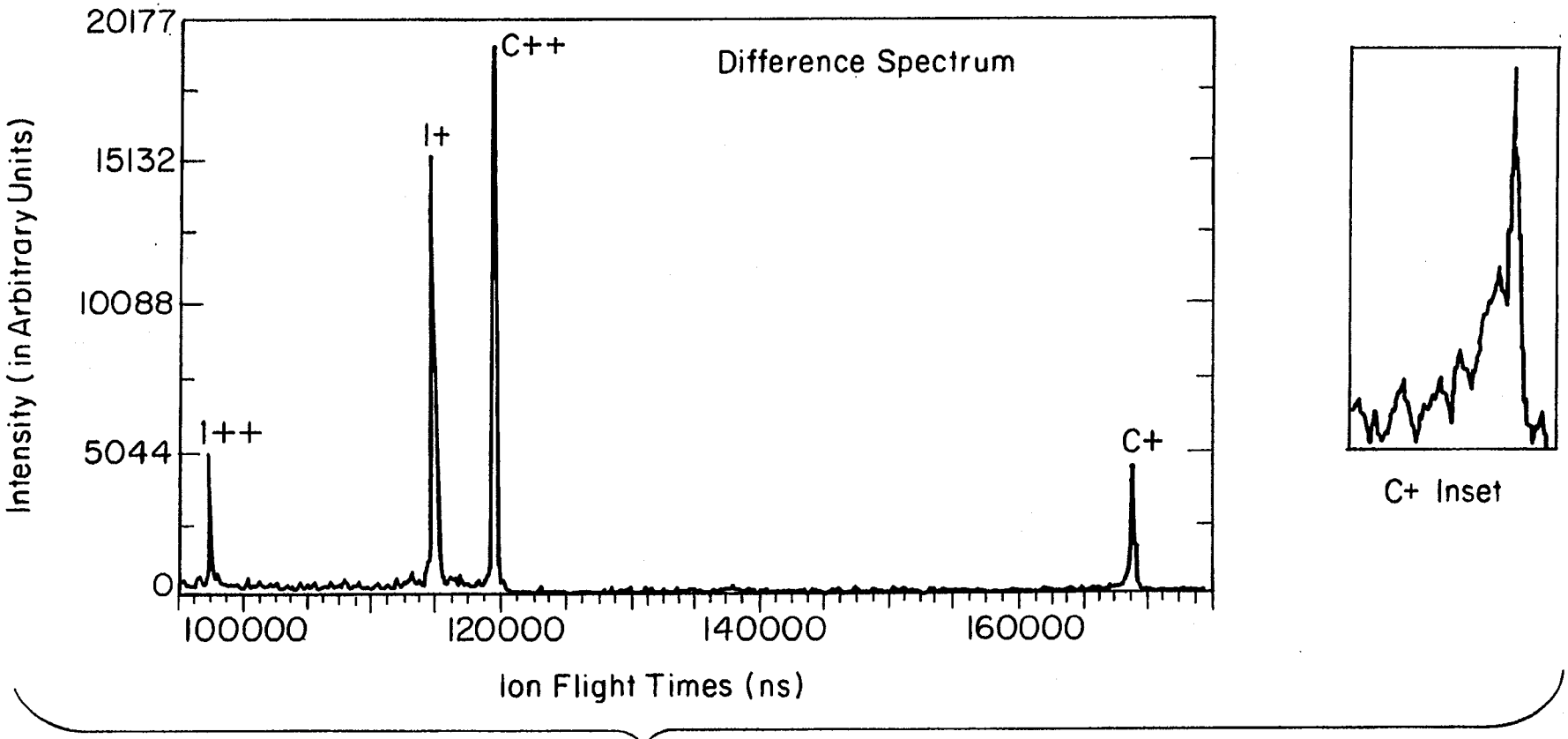
FIG. 3 is a spectrum of the sample of FIG. 2 which illustrates the performance of the present invention.
Figure 4:
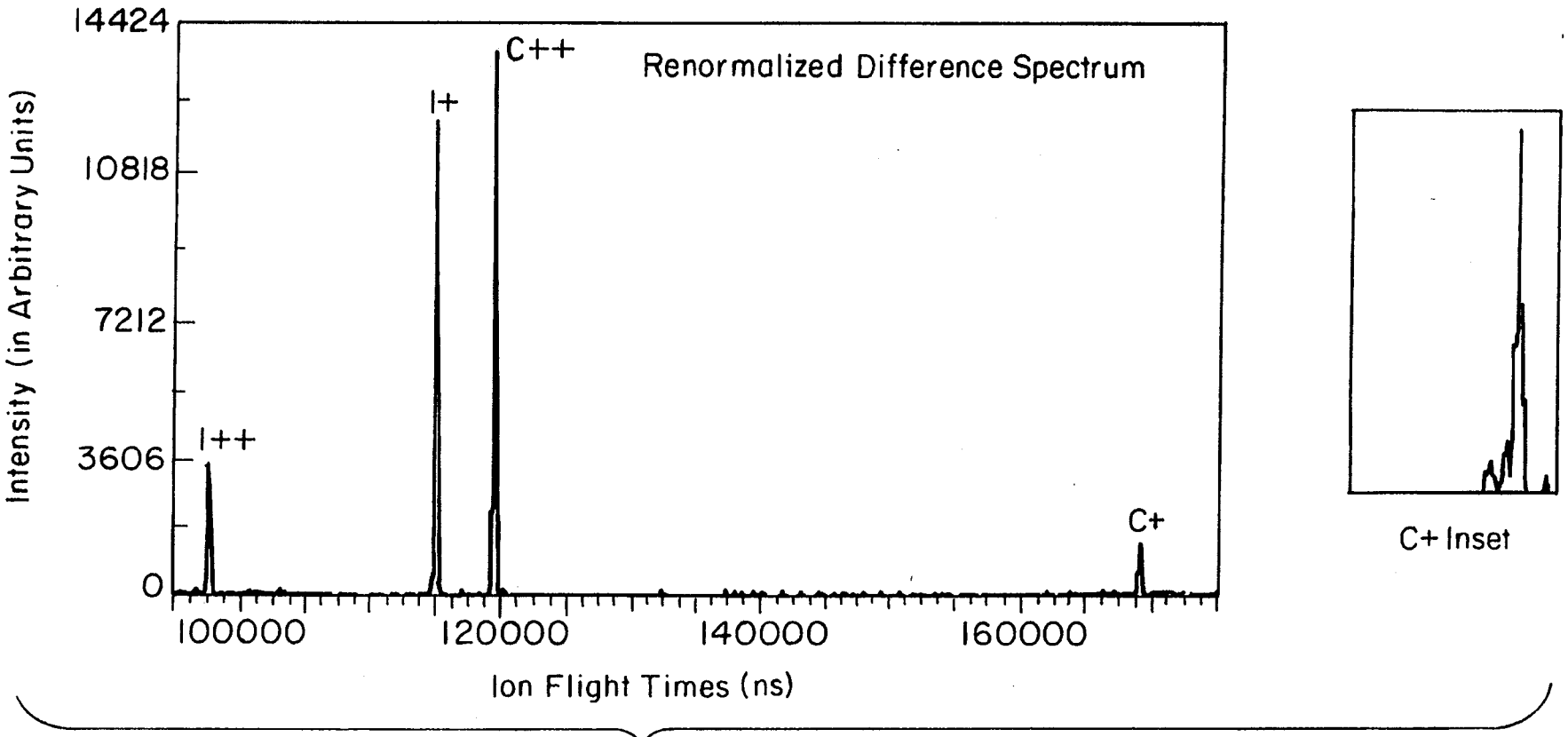
FIG. 4 is a spectrum of the sample of FIG. 2 which illustrates the performance of an enhanced form of the invention.

FIG. 3 demonstrates the resolution enhancement relative to the data depicted in FIG. 2 that is obtained by a) rejecting all transients whose amplitude are greater or less than certain predetermined values and b) removing the contribution of fragment peaks by subtracting the average of transients obtained when the mass spectrometer is set with $V_a=V_m+\epsilon V_d$ so that only fragment ions are detected, from the average of transients obtained when the mass spectrometer is set with $V_a=V_m-\epsilon V_d$ so that both parent and fragment ions are detected. FIG. 4 demonstrates the further resolution enhancement relative to the data depicted in FIG. 3 that is obtained when the amplitudes of individual transients are normalized to the amplitudes of the fragment ions from the peak of interest prior to obtaining a difference spectrum. To further illustrate the enhanced resolution achievable by the present invention, attention is directed to the inset shown in FIGS. 2, 3 and 4 which represents a blow-up of the C+ peak. As shown, the peaks of FIGS. 3 and 4 have less spreading and significantly reduced amplitude of the tailed portion of the peak.

In principle, all of the above techniques described in this embodiment could also be implemented by alternately varying the mirror voltage $V_m$ supplied by source 15 instead of the accelerating voltage $V_a$. However, this method is less convenient since ion transit times will vary as a function of the applied mirror voltage, whereas the transit times for ions of a given mass are almost independent of small changes in the target voltage $V_a$ supplied by source 16. In addition, various other schemes of triggering the laser 1 and the transient recorder 12 could be devised which achieve the same objectives described herein. Still other modifications will be evident to those skilled in the art and are also intended to be covered by the claims of this invention.

What is claimed is:

1. Apparatus for enhancing the mass resolution of parent ions from a population of ions detected by a detector means in a reflecting time-of-flight mass spectrometer, said population of ions being imparted an initial kinetic energy by an electric field comprising:

means for modulating said electric field such that parent ions of interest of said parent ions are either substantially detected or substantially not detected by said detector means while fragment ions derived from said parent ions of interest are substantially detected independent of said modulation;

means for storing successive electrical signals generated by said detector means; and means for generating a difference signal between said electrical signals stored when said parent ions are substantially detected and said electrical signals stored when said parent ions are not substantially detected.

2. The apparatus of claim 1 wherein said means for modulating further includes means for modulation of said electric field on consecutive pulses of a laser producing said parent ions by matrix-assisted desorption of said parent ions and wherein said means for generating further includes means for generating a difference signal from electrical signals corresponding to said consecutive laser pulses.

3. The apparatus of claim 1 which includes means for rejecting and not recording electrical signals that fall above or below predetermined threshold values.

4. The apparatus of claim 2 which includes means for rejecting and not recording electrical signals that fall above or below predetermined threshold values.

5. The apparatus of claim 1 which includes means for normalizing the amplitudes of said successive electrical signals to the amplitudes of a fragment ion derived from said parent ion of interest.

6. The apparatus of claim 2 which includes means for normalizing the amplitudes of said successive electrical signals to the amplitudes of a fragment ion derived from said parent ion of interest.

7. The apparatus of claim 3 which includes means for normalizing the amplitudes of said successive electrical signals to the amplitudes of a fragment ion derived from said parent ion of interest.

8. A method for enhancing the mass resolution of parent ions from a population of ions detected by a detector means in a reflecting time-of-flight mass spectrometer, said population of ions being imparted an initial kinetic energy by an electric field comprising:

modulating said electric field such that parent ions of interest of said parent ions are either substantially detected or substantially not detected by said detector means while fragment ions derived from said parent ions of interest are substantially detected independent of said modulation;

storing successive electrical signals generated by said detector means; and generating a difference signal between said electrical signals stored when said parent ions are substantially detected and said electrical signals stored when said parent ions are not substantially detected.

9. The method of claim 8 wherein said modulating further includes modulating said electric field on consecutive pulses of a laser producing said parent ions by matrix-assisted desorption of said parent ions and wherein said generating further includes generating a difference signal from electrical signals corresponding to said consecutive laser pulses.

10. The method of claim 8 which includes rejecting and not recording electrical signals that fall above or below predetermined threshold values.

11. The method of claim 8 which includes normalizing the amplitudes of said successive electrical signals to the amplitudes of a fragment ion derived from said parent ion of interest.

* * * * *